US006590543B1

(12) United States Patent
Apostolos

(10) Patent No.: US 6,590,543 B1
(45) Date of Patent: Jul. 8, 2003

(54) DOUBLE MONOPOLE MEANDERLINE LOADED ANTENNA

(75) Inventor: John T. Apostolos, Merrimack, NH (US)

(73) Assignee: BAE Systems Information and Electronic Systems Integration Inc, Nashua, NH (US)

( * ) Notice: Subject to any disclaimer, the term of this patent is extended or adjusted under 35 U.S.C. 154(b) by 0 days.

(21) Appl. No.: 10/265,506

(22) Filed: Oct. 4, 2002

(51) Int. Cl.[7] ..... H01Q 11/14

(52) U.S. Cl. ..... 343/742; 343/744; 343/750; 343/752; 343/828; 343/846

(58) Field of Search ..... 343/722, 723, 343/742–745, 748–752, 823, 825, 826, 828, 829, 846–848, 861, 868

(56) References Cited

U.S. PATENT DOCUMENTS

| | | | | | |
|---|---|---|---|---|---|
| 2,156,661 | A | * | 5/1939 | Wells | 343/828 |
| 5,790,080 | A | * | 8/1998 | Apostolos | 343/744 |
| 6,313,716 | B1 | * | 11/2001 | Apostolos | 333/162 |
| 6,323,814 | B1 | * | 11/2001 | Apostolos | 343/744 |
| 6,373,440 | B2 | * | 4/2002 | Apostolos | 343/744 |
| 6,404,391 | B1 | * | 6/2002 | Apostolos | 343/700 MS |
| 6,417,806 | B1 | * | 7/2002 | Gothard et al. | 343/700 MS |

* cited by examiner

*Primary Examiner*—Michael C. Wimer
(74) *Attorney, Agent, or Firm*—Maine & Asmus

(57) ABSTRACT

A wideband double monopole meanderline loaded antenna having a single feed a single feed is disclosed. Equalizing delay lines of the antenna can be manipulated to equalize reactance of the antenna thereby enabling proper impedance matching.

20 Claims, 4 Drawing Sheets

DOUBLE MONOPOLE MEANDERLINE LOADED ANTENNA

FIELD OF THE INVENTION

The present invention relates to antennas and, more specifically to double monopole meanderline loaded antennas.

BACKGROUND OF THE INVENTION

In the past, efficient antennas have typically required structures with minimum dimensions on the order of a quarter wavelength of the lowest operating frequency. These dimensions allowed the antenna to be excited easily and to be operated at or near resonance, limiting the energy dissipated in impedance losses and maximizing the transmitted energy. However, such antennas tended to be large in size at the resonant wavelength, and especially so at lower frequencies.

In order to address the shortcomings of traditional antenna design and functionality, the meanderline loaded antenna (MLA) was developed. U.S Pat. Nos. 5,790,080 and 6,313,716 each disclose meanderline loaded antennas. Both of these patents are hereby incorporated by reference in their entirety.

Generally, an MLA (also known as a "variable impedance transmission line" or VITL antenna) is made up of a number of vertical sections and horizontal sections. The vertical and horizontal sections are separated by gaps. Meanderlines are connected between at least one of the vertical and horizontal sections at the corresponding gaps. A meanderline is designed to adjust the electrical (i.e., resonant) length of the antenna, and is made up of alternating high and low impedance sections. By switching lengths of the meanderline in or out of the circuit, time delay and phase adjustment can be readily accomplished.

Such a switchable meanderline allows the antennas to have a very wide tunable bandwidth. However, the bandwidth available for simultaneous or instantaneous use can be relatively limited in certain applications, such as multi-band or multi-use applications, or those where signals can appear unexpectedly over a wide frequency range. Examples of wideband MLA configurations are discussed in U.S. Pat. No. 6,323,814, which is herein incorporated by reference. For instance, an opposed pair of MLAs are adapted to operate in the monopole or vertical polarization mode relative to aground. In another configuration, two opposed pairs of MLAs sharing a common ground plane form a quad antenna.

These wideband MLA configurations provide a monopole mode, but require two or more feeds. Such multiple feed configurations typically require the use of supporting circuitry, such as 4-to-1 combiner circuitry in the case of a quad configuration. A wideband monopole MLA having a single feed may be desirable given the growing need for wideband antennas used in systems such as wireless and satellite applications (e.g., GPS and cellular telephone platforms).

What is needed, therefore, is a wideband monopole MLA having a single feed.

BRIEF SUMMARY OF THE INVENTION

One embodiment of the present invention provides a double monopole meanderline loaded antenna. The antenna includes a horizontal reference plane, a pair of horizontal radiators, and a vertical radiator. Each horizontal radiator has an edge, and the edges are spatially located near each other thereby defining a gap. The vertical radiator is adapted to receive a single feed, and has a first end that is operatively coupled to the reference plane, and a second end located proximate the gap. The antenna further includes a pair of equalizing delay lines. Each equalizing delay line has a first end connected proximate the edge of one horizontal radiator, and a second end connected proximate the second end of the vertical radiator. In addition, each equalizing delay line has a low impedance section and a high impedance section relative to the corresponding horizontal radiator. The equalizing delay lines can be manipulated to equalize reactance of the antenna.

Alternatively, each equalizing delay line has its first end operatively coupled proximate the edge of one horizontal radiator and its second end operatively coupled to the ground plane (as opposed to the horizontal radiator). In this embodiment, each equalizing delay line has a low impedance section that is substantially parallel to its corresponding horizontal radiator, and a high impedance section that is capacitively coupled to the vertical radiator.

Another embodiment of the present invention provides a method of manufacturing a double monopole meanderline loaded antenna. The method includes providing a horizontal reference plane, and providing a pair of horizontal radiators. Each horizontal radiator has an edge wherein the edges are spatially located near each other thereby defining a gap. The method further includes providing a vertical radiator adapted to receive a single feed. The vertical radiator has a first end that is operatively coupled to the reference plane, and a second end located proximate the gap. The method proceeds with providing a pair of equalizing delay lines. Each equalizing delay line has a first end that is operatively coupled proximate the edge of one horizontal radiator and a second end that is operatively coupled to the reference plane. Alternatively, each second end is operatively coupled proximate the second end of the vertical radiator. In either case, each equalizing delay line has a low impedance section and a high impedance section, and the equalizing delay lines are adapted for manipulation during a tuning process to equalize reactance of the antenna.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

Figure 1:
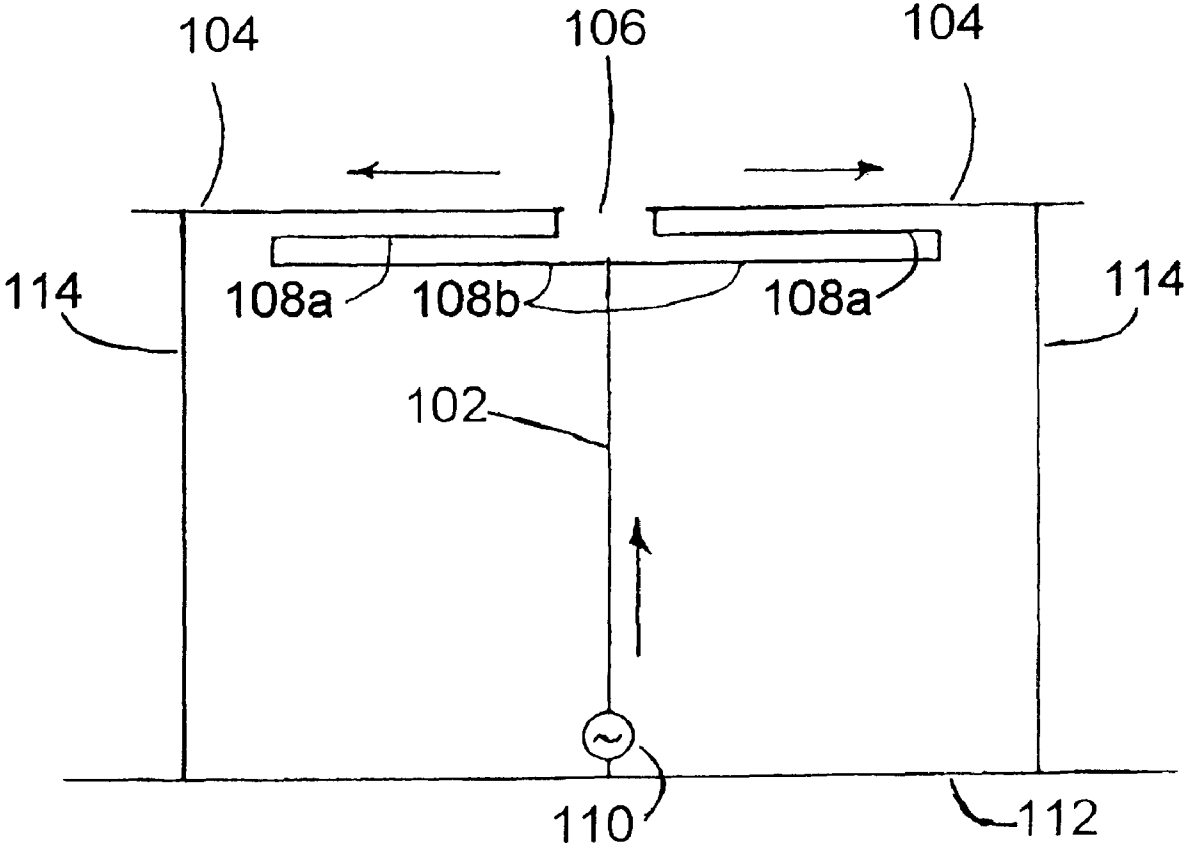
FIG. 1 is a side view diagram illustrating a double monopole meanderline loaded antenna in accordance with one embodiment of the present invention.

FIG. 1 is a side view diagram illustrating a double monopole meanderline loaded antenna in accordance with one embodiment of the present invention. The antenna includes a pair of horizontal radiators 104. Each horizontal radiator 104 has an edge wherein the edges are spatially located near each other thereby defining a gap 106. A vertical radiator 102 has a first end that is operatively coupled to the reference plane 112, which in this case is ground. A second end of the vertical radiator 102 is located proximate the gap 106. The vertical radiator 102 is adapted to receive a single feed, which is represented here as a source 110. Two vertical supports 114 are each connected between respective horizontal radiators 104 and ground plane 112, but on opposite sides of the vertical radiator 102.

There are two equalizing delay lines 108, where each one is connected between the vertical radiator 102 and a corresponding horizontal radiator 104. Each equalizing delay line includes a low impedance section 108*a* and a high impedance section 108*b*. In this sense, each equalizing delay line 108 is a two section meanderline or variable impedance transmission line (VITL).

The impedance of each section is relative to the corresponding horizontal radiator 104. The closer in distance that the equalizing delay line section is to the horizontal radiator 104, the lower the impedance of that section. Likewise, the further in distance the equalizing delay line section is from the horizontal radiator 104, the higher the impedance of that section.

Generally, the reactance of the antenna can be effectively equalized so as to present a substantially flattened impedance over a wide frequency band by manipulating the equalizing delay lines 108. The magnitude of the presented impedance can be some predetermined value or range (e.g., such as 50 ohms +/−5 ohms), thereby facilitating proper impedance matching to the system with which the antenna is communicating. As such, a good voltage standing wave ratio (VSWR) can be achieved over a wide band. The flatness of the impedance over a given frequency range will depend on factors such as the specified impedance tolerance required for proper matching.

The antenna can be tuned to provide a particular impedance, for example, by sweeping source 110 over a frequency range (e.g., 300 MHz to 3 GHz) while monitoring the reactance of the antenna using an impedance or network analyzer test set. The equalizing delay lines 108 can be manually manipulated by a test person while observing the test set, until a desired impedance is presented. Once tuned, note that the equalizing delay lines 108 can be secured from further movement with a suitable epoxy or other immobilizing dielectric if so desired. Generally, the material from which equalizing delay lines 108 are made is such that they are easily manipulated (e.g., bendable), but will retain a shape once formed.

An automated tuning process could also be employed, where the equalizing delay lines 108 are mechanically manipulated, for instance, via robotics. The analyzing test set could then provide impedance data to a module programmed to interpret the impedance data, and to direct the robotics to move the equalizing delay lines 108 accordingly. Such a closed-loop, automatic tuning process could be employed in a manufacturing environment thereby reducing the need for skilled test persons. The antenna structure being tuned would only have to be connected into a test fixture operatively interfaced to the test set and robotics.

An automatic test set might include, for example, an impedance analyzer coupled to an interface bus of a computer system (e.g., central processing unit; memory-ROM/RAM; I/O control module for reading/writing logic for the likes of controlling switches and providing input stimulus; monitor, etc.). A robotics system could be interfaced with the computer system via a peripheral interface adapter (PIA) or other suitable interface mechanism. Conventional programming techniques could be used to configure the test set (utilizing the instruction sets of the analyzer and robotics) to perform a pre-established tuning routine that was developed based on manual testing and performance data.

The tuning process can be refined and optimized based on historical data, which can be collected and stored in the computer system memory. Thus, assuming the antenna of FIG. 1 is manufactured to have an initial default tuning, the antenna structure can be engaged into the test set and then readily tuned with a number of predictable steps to achieve the target impedance.

Each of the ground plane 112, vertical radiator 102, vertical supports 114, and the horizontal radiators 104 can be implemented with a number of metal or alloy conductors, such as aluminum or copper. Fasteners (e.g., steel screws) or suitable conductive adhesives (e.g., solder or conductive epoxy) can be used to bond the radiators, supports, and ground plane. In addition, the ground plane 112 can be deposited on a printed circuit board (PCB) or other suitable medium, where a microwave I/O port (e.g., SMA connector) is fastened to the PCB, and electrically coupled to the vertical radiator 102 so as to interface with the feed point 110.

The equalizing delay lines 108 can be implemented, for example, with ribbon copper, aluminum foil, or other suitable, flexible conductor material. Such material can be manipulated to a particular position or shape and will generally not move from that position unless disturbed. The connection points of the equalizing delay lines 108 to the horizontal radiators 104 and vertical radiator 102 can be achieved with a solder or other suitable conductive adhesive. Note that a dielectric material may be deployed between the low impedance sections 108*a* of the equalizing delay lines 108 and the respective horizontal radiators 104. A dielectric of air is demonstrated in the embodiment depicted in FIG. 1.

Vertical supports 114 may take various forms. In the embodiment shown, the vertical supports 114 are each formed as a transmission line that extends up to horizontal radiator 104. Alternatively, each vertical support 114 may have some other suitable shape, such as an impedance matching section. Such a vertical support is disclosed in U.S. Pat. No. 6,323,814 (e.g., reference 212 of FIG. 4C), which is herein incorporated by reference in its entirety.

Vertical supports 114 are shown to be oriented in parallel to vertical radiator 102. In this manner, a certain amount of capacitance is created depending upon the proximity of the particular vertical support 114 to vertical radiator 102, and upon the relative surface area of vertical supports 114. Such capacitance may be varied through control of these two aspects. Generally, vertical supports 114 are designed to have a characteristic impedance along at least a portion thereof which is comparable to the overall characteristic impedance of the corresponding equalizing delay line 108. The characteristic impedance of each equalizing delay line 108 is nominally equal to the square root of the product of the impedances associated with the low impedance section 108*a* and the high impedance section 108*b* thereof.

Note that the vertical supports 114 can be manipulated (e.g., in shape or location) to provide a course adjustment of the antenna impedance. For example, the distance that the vertical supports 114 are located from the vertical radiator 102 can be varied while monitoring the impedance of the antenna. A fine tuning can then be performed by manipulating the equalizing delay lines 108 as explained herein.

Appreciable currents are indicated with arrows, where the horizontal currents associated with the horizontal radiators 104 tend to cancel, while the vertical current associated with the vertical radiator 102 provides the majority of radiation. Note that the vertical radiator 102 is spatially singular. This is in contrast, for instance, to wide band quad antenna configurations, which have four spatially separated feeds and vertical radiators.

Thus, a degree of efficiency is afforded by employing the principles of the present invention. In addition, recall that a signal transmitted from a monopole antenna is omni-directional, where the signal is transmitted with basically the same signal strength in all directions in a generally horizontal plane. Likewise, reception of signals with a monopole antenna is omni-directional. With embodiments of the present invention, more omni-directional patterns at higher frequencies are possible than with conventional monopole antennas.

Figure 2:
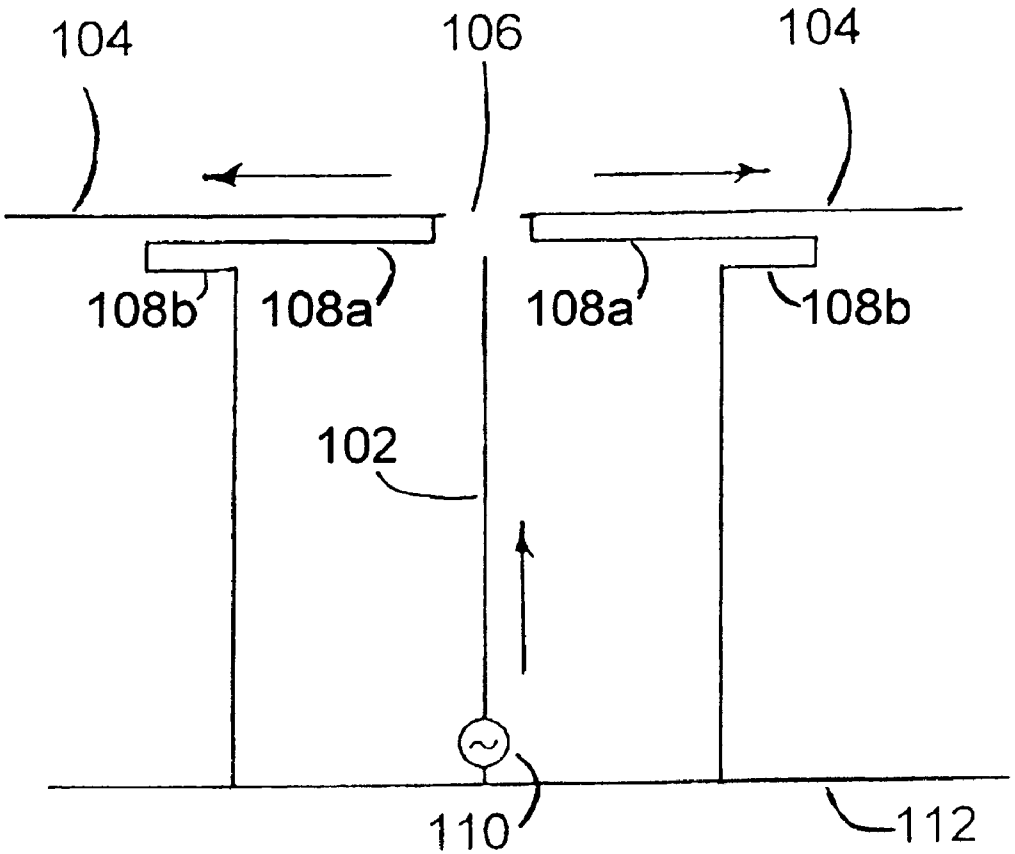
FIG. 2 is a side view diagram illustrating a double monopole meanderline loaded antenna in accordance with another embodiment of the present invention.

FIG. 2 is a side view diagram illustrating a double monopole meanderline loaded antenna in accordance with another embodiment of the present invention. In this configuration, the equalizing delay lines 108 are capacitively coupled to the vertical radiator 102, as opposed to being directly coupled as illustrated in FIG. 1. The degree of capacitive coupling depends on factors such as the distance between the equalizing delay line 108 and the vertical radiator 102, as well as the surface area of the equalizing delay line 108.

Generally, the characteristic impedance of the equalizing delay lines 108 is nominally equal to the square root of the product of the impedance values associated with the low impedance section 108*a* and the high impedance section 108*b*. Thus, this configuration can be used to provide a different characteristic impedance than that provided by the configuration illustrated in FIG. 1. Numerous other configurations will be apparent in light of this disclosure, and the present invention is not intended to be limited to any one such embodiment.

Note that vertical supports 114 are not illustrated in this figure, but may be employed as discussed in reference to FIG. 1. Other disclosure made in reference to FIG. 1 is equally relevant here. For example, the materials and manufacturing techniques employed can be the same. Likewise, the appreciable currents behave similarly.

Figure 3:
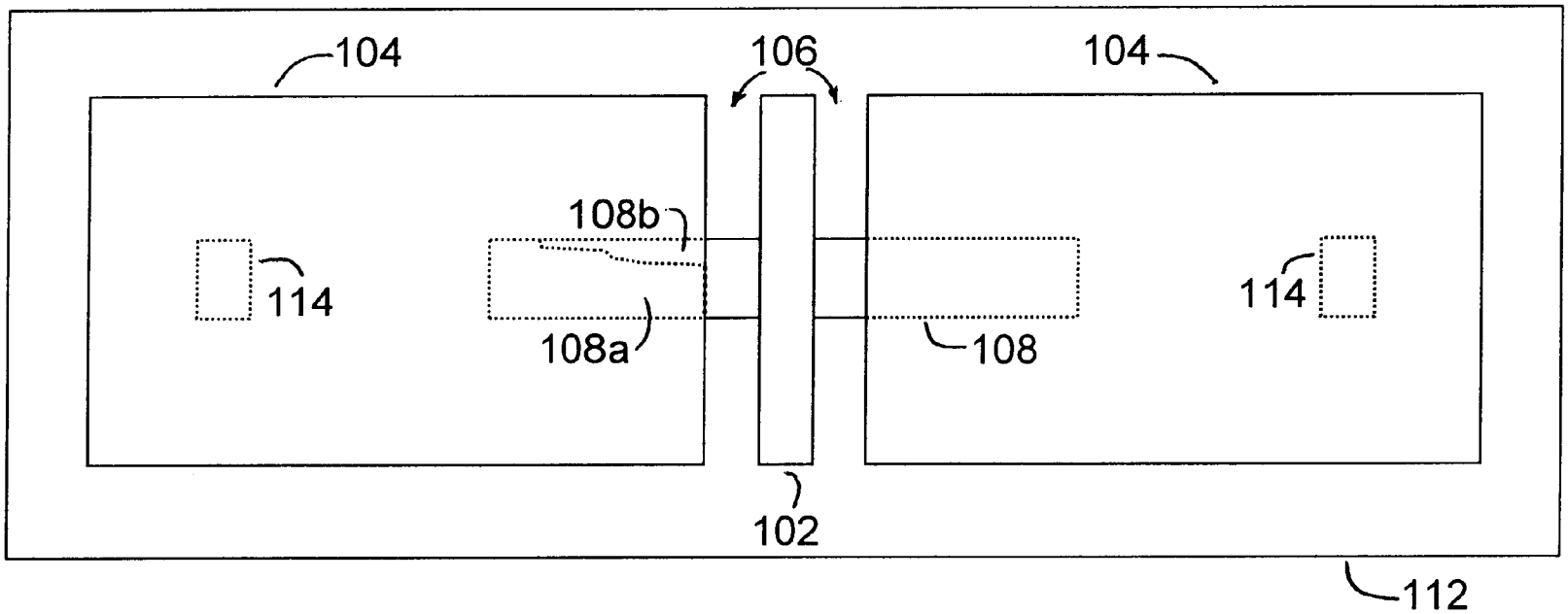
FIG. 3 is a top view diagram illustrating the double monopole meanderline loaded antenna illustrated in FIG. 1.

FIG. 3 is a top view diagram illustrating the double monopole meanderline loaded antenna illustrated in FIG. 1. The previous discussion relevant to FIG. 1 equally applies here. Note the dashed lines indicating componentry otherwise hidden from top view observation. Vertical supports 114 may be narrower or wider as can be appreciated, and may take on different shapes and materials to beneficially impact the desired impedance from the overall antenna structure.

In addition, the gap 106 may be varied depending on the desired capacitive coupling between the horizontal radiators 104 and the vertical radiator 102. In this particular embodiment, note that the low impedance section 108*a* is shorter in length than the high impedance section 108*b*. As will be apparent in light of this disclosure, manipulating the equalizing delay lines 108 enables a manipulation of the residual reactance of the antenna. For example, the residual reactance can be effectively neutralized by changing the lengths, shapes, and distance from the horizontal radiator of the sections of the equalizing delay lines 108.

The actual dimensions of the radiators, ground plane, supports, equalizing delay lines, and gap will vary depending on factors such as the frequency band of operation and desired results. In one embodiment, relevant dimensions are as follows: the reference plane 112 is 4 inches wide and 6 inches long; the horizontal radiators 104 are each 2.5 inches wide and 3 inches long; the vertical supports 114 are 1.6 inches high and ⅜ inches wide; the vertical radiator 102 is 1.5 inches high and 3 inches wide; each equalizing delay line 108 is ¼ inches wide×2 inches long (measured from vertical radiator 102 to turning point between high and low impedance sections); each low impedance section 108*a* is spaced 0.03 inches from its corresponding horizontal radiator 104, while each high impedance section 108*b* is spaced 0.09 inches from the corresponding horizontal radiator 104; and the gap is 0.1 inches. The frequency band of operation for this particular example is from 400 MHz to 2.5 GHz.

Figure 4:
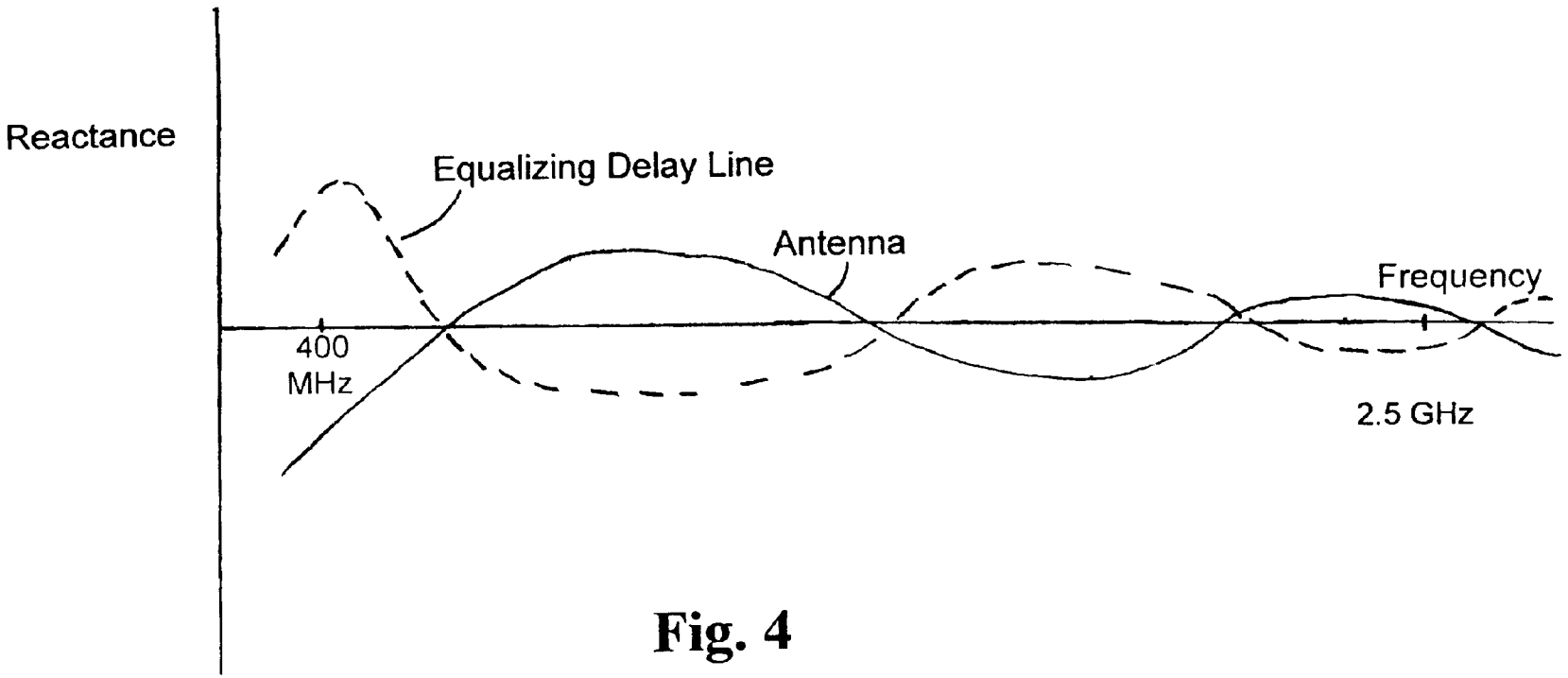
FIG. 4 is a graphical presentation illustrating reactance of elements included in the antennas of FIGS. 1 or 2 over a wide band of frequencies.

FIG. 4 is a graphical presentation illustrating reactance of elements included in the antennas of FIG. 1 or 2 over a wide band of frequencies. In particular, the residual reactance associated with the antenna radiating elements is depicted with the solid sinusoidal decaying signal, and the reactance associated with the equalizing delay lines 108 is depicted with the dashed sinusoidal decaying signal.

As can be seen, the equalizing delay lines 108 have been adjusted so that their associated impedance is substantially 180° out-of-phase with the impedance associated with the antenna. This complementary impedance scheme results in a relatively flat overall impedance associated with the antenna for the frequency band of operation, which in this example ranges from 400 MHz to 2.5 GHz. Thus, the overall impedance of the antenna can be set to a desired level for purposes of obtaining an properly matched antenna and good VSWR characteristics.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A double monopole meanderline loaded antenna, the antenna comprising:

a horizontal reference plane;

a pair of horizontal radiators, each horizontal radiator having an edge wherein the edges are spatially located near each other thereby defining a gap;

a vertical radiator adapted to receive a single feed and having a first end operatively coupled to the reference plane, and a second end located proximate the gap; and a pair of equalizing delay lines, each equalizing delay line having a first end connected proximate the edge of one horizontal radiator and a second end connected proximate the second end of the vertical radiator, each equalizing delay line having a low impedance section and a high impedance section relative to the corresponding horizontal radiator, wherein the equalizing delay lines can be manipulated to equalize reactance of the antenna.

2. The antenna of claim 1 further comprising:

a pair of vertical supports, each vertical support operatively coupled between the reference plane and a corresponding one of the horizontal radiators on opposite sides of the vertical radiator.

3. The antenna of claim 2 wherein the vertical supports can be manipulated to provide a course adjustment of antenna impedance.

4. The antenna of claim 1 wherein a substantially flattened impedance over a wide frequency band is provided by manipulating the equalizing delay lines, the flattened impedance having a magnitude corresponding to a predetermined range.

5. The antenna of claim 1 wherein each equalizing delay line is secured to the vertical radiator and respective horizontal radiator with solder.

6. The antenna of claim 1 wherein each equalizing delay line is a flexible conductor material.

7. The antenna of claim 1 wherein a dielectric material is deployed between the low impedance sections of the equalizing delay lines and the respective horizontal radiators.

8. A double monopole meanderline loaded antenna, the antenna comprising:

a horizontal reference plane;

a pair of horizontal radiators, each horizontal radiator having an edge wherein the edges are spatially located near each other thereby defining a gap;

a vertical radiator adapted to receive a single feed and having a first end operatively coupled to the reference plane, and a second end located proximate the gap; and a pair of equalizing delay lines, each equalizing delay line having a first end operatively coupled proximate the edge of one horizontal radiator and a second end operatively coupled to the ground plane, each equalizing delay line having a low impedance section that is substantially parallel to its corresponding horizontal radiator and a high impedance section that is capacitively coupled to the vertical radiator.

9. The antenna of claim 8 further comprising:

a pair of vertical supports, each vertical support operatively coupled between the reference plane and a corresponding one of the horizontal radiators on opposite sides of the vertical radiator.

10. The antenna of claim 9 wherein the vertical supports can be manipulated to provide a course adjustment of antenna impedance.

11. The antenna of claim 8 wherein a substantially flattened impedance over a wide frequency band is provided by manipulating the equalizing delay lines, the flattened impedance having a magnitude corresponding to a predetermined range.

12. The antenna of claim 8 wherein each equalizing delay line is secured to the reference plane and respective horizontal radiator with a solder.

13. The antenna of claim 8 wherein each equalizing delay line is a flexible conductor material.

14. The antenna of claim 8 wherein a dielectric material is deployed between the low impedance sections of the equalizing delay lines and the respective horizontal radiators.

15. A method of manufacturing a double monopole meanderline loaded antenna, the method comprising:

providing a horizontal reference plane;

providing a pair of horizontal radiators, each horizontal radiator having an edge wherein the edges are spatially located near each other thereby defining a gap;

providing a vertical radiator adapted to receive a single feed and having a first end operatively coupled to the reference plane, and a second end located proximate the gap;

providing a pair of equalizing delay lines, each equalizing delay line having a first end operatively coupled proximate the edge of one horizontal radiator and a second end operatively coupled to one of the reference plane or proximate the second end of the vertical radiator, each equalizing delay line having a low impedance section and a high impedance section, wherein the equalizing delay lines are adapted for manipulation during a tuning process to equalize reactance of the antenna.

16. The method of claim 15 further comprising:

providing a pair of vertical supports, each vertical support operatively coupled between the reference plane and a corresponding one of the horizontal radiators on opposite sides of the vertical radiator; and manipulating the vertical supports to provide a course adjustment of antenna impedance.

17. The method of claim 15 further comprising:

manipulating the equalizing delay lines to provide a substantially flattened impedance over a wide frequency band, the flattened impedance having a magnitude corresponding to a predetermined range.

18. The method of claim 15 wherein each equalizing delay line is a flexible conductor material.

19. The method of claim 15 wherein the tuning process is automated.

20. The method of claim 15 wherein the antenna has an initial default tuning, and the tuning process is based on historical data.

* * * * *